US005180201A

United States Patent [19]

Hauber

[11] Patent Number: 5,180,201

[45] Date of Patent: Jan. 19, 1993

[54] CAMPER SHELL LATCH WITH INSIDE SAFETY RELEASE

[76] Inventor: Peter Hauber, 9901 Helen Ave., Sunland, Calif. 91040

[21] Appl. No.: 869,921

[22] Filed: Apr. 16, 1992

[51] Int. Cl.[5] ..... E05B 13/00

[52] U.S. Cl. ..... 292/336.3; 292/DIG. 27; 292/DIG. 37; 70/208

[58] Field of Search ..... 70/208; 292/7, 336.3, 292/DIG. 27, DIG. 37, 64–66, DIG. 36, 359

[56] References Cited

U.S. PATENT DOCUMENTS

| | | | |
|---|---|---|---|
| 2,497,328 | 2/1950 | Smith | 292/DIG. 27 |
| 2,700,290 | 1/1955 | Dall | 292/DIG. 27 |
| 3,111,833 | 11/1963 | Dettmer | 70/208 |
| 3,187,526 | 6/1965 | Moler | 292/7 |
| 3,683,652 | 8/1972 | Halopoff et al. | 292/DIG. 36 |
| 4,443,032 | 4/1984 | Bonassi | 292/DIG. 77 |
| 4,639,021 | 1/1987 | Hope | 292/7 |
| 4,689,976 | 9/1987 | Larsen | 70/208 |
| 4,898,408 | 2/1990 | Hauber | 70/208 |
| 4,966,018 | 10/1990 | Hauber | 70/208 |
| 5,072,978 | 12/1991 | Woodward | 292/359 |

FOREIGN PATENT DOCUMENTS

| | | | |
|---|---|---|---|
| 803698 | 4/1951 | Fed. Rep. of Germany | 292/DIG. 27 |
| 11816 | of 1896 | United Kingdom | 70/208 |
| 1175663 | 12/1969 | United Kingdom | 70/208 |
| 1179411 | 1/1970 | United Kingdom | 70/208 |

*Primary Examiner*—Eric K. Nicholson
*Attorney, Agent, or Firm*—Louis J. Bachand

[57] ABSTRACT

A camper shell door latch which while locked is openable from within the camper shell by a push button nut which shifts out of locking engagement with a bushing shoulder of limited axial extent to free the latch for inside actuation.

17 Claims, 1 Drawing Sheet 10
12
12a
14
16
16a
16b
18
20
22
24
26
28
30
32
34
36
38
38a
40
42
44
46
50
52
A
3
3

CAMPER SHELL LATCH WITH INSIDE SAFETY RELEASE

TECHNICAL FIELD

This invention has to do with latches for camper shells, which can be opened from within the camper shell, while locked from the outside. More particularly, the invention relates to an improvement in inside quick release latches to make them difficult to operate by thieves, but easy to operate by occupants of a camper shell.

BACKGROUND

Camper shells are designed with outward opening doors held in place by locking mechanisms comprising a pair of horizontally shiftable arms which interfit with keepers in the shell wall beyond the door. The arm movement between latched and unlatched positions is controlled by an angularly displaceable inner housing which carries latch ears coupled to the inner ends of the arms and which by rotation on its axis shifts the arms into and out of keeper engagement. In U.S. Pat. No. 4,966,018, the disclosure of which is hereby incorporated by reference, a camper latch is disclosed having an inner and an outer housing, a shaft, a handle for rotating the shaft and in turn rotating the inner housing to actuate the latch arms. The inner housing was rotatable 90 degrees with the shaft locked to permit opening the camper shell door from within. Inner housing rotation was by application of angular force to an inside handle fixed to the inner housing.

SUMMARY OF THE INVENTION

The inside handle on the inner housing in some installations can be moved from outside the camper shell where the gap between shall door and shell wall permit insertion of a long thin tool, enabling break-ins by actuation of the inside handle from without.

It is an object of this invention to provide a camper shell latch which is secure and safe, which has an inside release and which positively blocks unauthorized actuation of the inside handle. It is another object to provide a camper shell latch in which actuation of the inside release requires axial pressure on the latch which is not applicable by tools inserted from the side of the camper shell door. It is another object to provide a push button latch release, releasing the inside handle for rotation.

These and other objects of the invention to become apparent hereinafter are realized in a camper shell door latch comprising inside latch means operated by a handle and an outside lockable shaft, and first and second relatively shiftable elements respectively acted on by the shaft and fixed to the latch means, the elements being engaged with each other in one position to block latch means operation in the locked condition of the shaft and disengaged from each other in a second, relatively shifted position while maintaining the outside locked condition of the shaft, whereby the latch means is operable from within the camper shell to unlatch the door while the shaft is locked from the outside.

In this and like embodiments, the elements are centered on the axis of the shaft, and shiftable axially relative to one another into and out of engagement; the first of the elements defines a circumferential shoulder, and the second of the elements defines shoulder cooperating structure circumscribing the shoulder, the second element structure being shiftable into and out of engagement with the shoulder by relative movement of the first and second elements; the first element shoulder has radial polygonal faces, and the second element has polygonal shoulder cooperating structure shaped and sized to engage the first element shoulder when in juxtaposition therewith; the first element shoulder is concentric with the axis of the shaft and limited in axial extent, the second element having shoulder cooperating structure having limited axial extent, whereby axial shifting of the first and second elements shifts the shoulder cooperating structure a distance greater than the shoulder axial length to disengage the shoulder cooperating structure from the shoulder; and, there is further included an inner housing rotatable by the shaft, the housing carrying the inside latch means, the first element comprising a bushing centering the shaft within the inner housing and fixed within the inner housing for rotation therewith by the shaft, the bushing having a reduced end portion opposite the second element, the bushing reduced end portion having a peripheral, polygonal shoulder of relatively limited axial extent, the second element comprising an interiorly open nut having an inner peripheral shoulder cooperating structure of relatively limited axial extent adapted to engage the bushing reduced end portion shoulder, the nut being supported by the inner housing in outwardly projecting relation and normally in engagement with the first element shoulder against rotation of the inner housing without simultaneous rotation of the shaft, the nut being inwardly axially shiftable over the bushing reduced end portion a distance greater than the limited axial extent of the bushing reduced end portion peripheral shoulder to free the nut of engagement with the bushing, whereby the inner housing is rotatable about the shaft and the latch means is actuable thereby without shaft rotation.

In another embodiment, the invention provides in a camper shell door latch having inside quick release, comprising: a shaft; an outer housing adapted to be fixed to the outside of the camper shell door, the outer housing being centered on the shaft; an outer handle fixed to the shaft and journaled by the outer housing; locking means within the outer housing for locking the shaft relative to the outer housing; an inner housing on the inside the camper shell door; means centering the inner housing on the shaft, the inner housing being rotatable relative to the outer housing by the shaft, the inner housing carrying an inside handle and a latch means for latching and unlatching the camper shell door responsive to rotation of the inner housing; the improvement comprising the inner housing centering means comprising a bushing having a shoulder, and a cooperating nut normally engaging the shoulder to block rotation of the inner housing relative to the shaft, the bushing and the nut being relatively shiftable from inside the camper shell to disengage the shoulder and nut in inner housing rotation unblocking relation, whereby the inner housing is rotatable by the inside handle to unlatch the camper shell door in the locked condition of the locking means.

In this and like embodiments, typically, the bushing and the nut are each centered on the axis of the shaft, and shiftable axially relative to one another into and out of engagement; the bushing defines a circumferential shoulder, and the nut defines shoulder cooperating structure circumscribing the shoulder, the nut being shiftable into and out of engagement with the shoulder by relative axial movement thereof; the bushing shoulder has outwardly radial polygonal faces, and the nut shoulder cooperating structure has inwardly radial polygonal faces shaped and sized to engage the bushing shoulder when in juxtaposition therewith; and, the bushing shoulder is concentric with the shaft axis, and limited in axial extent, the nut shoulder cooperating structure having limited axial extent, whereby axial shifting of the nut shoulder cooperating structure past the bushing shoulder disengages the bushing from the nut to permit rotation of the inner housing.

In another embodiment the invention provides a camper shell door latch comprising an inner housing rotatable by a shaft, the housing carrying inside latch means, a first element comprising a bushing centering the shaft within the inner housing and fixed within the inner housing for rotation therewith by the shaft, a second element, the bushing having a reduced end portion opposite the second element, the bushing reduced end portion having a polygonal peripheral shoulder of relatively limited axial extent, the second element comprising an interiorly open nut having an inner peripheral shoulder of relatively limited axial extent adapted to engage the bushing reduced end portion shoulder, the nut being supported by the inner housing in outwardly projecting relation and normally in engagement with the first element shoulder against rotation of the inner housing without simultaneous rotation of the shaft, the nut being inwardly axially shiftable over the bushing reduced end portion a distance greater than the limited axial extent of the bushing shoulder to free the nut of engagement with the bushing, whereby the inner housing is rotatable about the shaft and the latch means is actuable without shaft rotation for opening the latch from within the camper shell.

In this and like embodiments, the housing defines an opening on the shaft axis, the nut is flanged at its inward end for capture at the inner housing opening and closed at its outer end to define a push button surface for application of force to shift the nut relative to the bushing.

THE DRAWINGS

The invention will be further described in conjunction with the attached drawings in which:

FIG. 1 is an exploded view of the invention latch;

FIG. 2 a side elevation view thereof;

DETAILED DESCRIPTION

Figures 1, 2, 3, 3A:
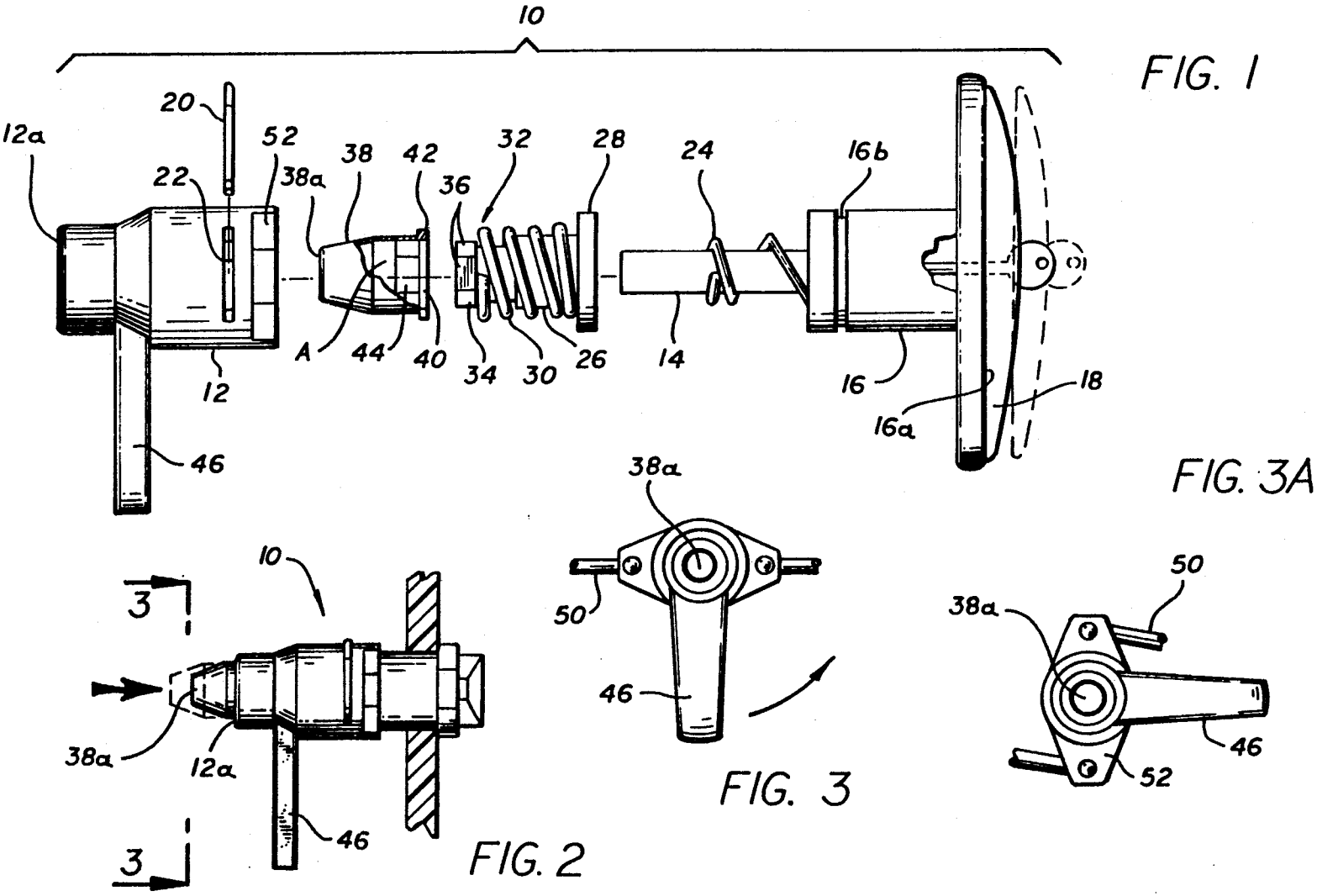
FIG. 3 is a view taken on line 3—3 in FIG. 2.
FIG. 3A is a view like FIG. 3 with the inner housing rotated.

With reference to the drawing in detail, the invention camper shell door latch is shown at 10 in FIGS. 1 to 4 and includes an inner housing 12, a shaft 14, the inner housing being rotatable by the shaft, an outer housing 16, a outside handle 18 which rotates the shaft and is nestable in the outer housing recess 16*a*. Outer housing 16 has a circumferential groove 16*b*, which, when the inner housing 12 is journaled on the outer housing, receives retaining clip 20 inserted in slots 22 in the inner housing. Inner housing 12 has an inward end opening 12*a* for purposes to appear.

The shaft 14 extends from the outside handle 18 through the outer housing 16 and the inner housing 12. Outer compression spring 24 centered on the shaft 14 urges the outside handle 18 from the outer housing recess 16*a* for turning. The handle 18 is retained in the recess 16*a* when locked.

Bushing 26 centers the shaft 14 within the inner housing 12. The bushing 26 is fixed within the inner housing 12 with circular shoulder 28 which also acts as a stop for inner compression spring 30. Bushing 26 has a reduced end portion 32 opposite the circular shoulder 28. Bushing reduced end portion 32 has a peripheral, polygonal shoulder 34 with plural outwardly radial faces 36.

Capped nut 38 is interiorly open at 40 to receive shaft 14 in interfitting relation. Nut 38 is flanged at 42 and sized to fit within inner housing 12 and project from the inner housing opening 12*a* a greater or less extent as shown in FIG. 2. Inner compression spring 30 bears on nut flange 42 urging the nut 38 out of the inner housing opening 12*a*.

Nut 38 further has an inner peripheral shoulder 44, polygonal and sized and shaped to circumscribe and complement the bushing reduced end portion shoulder 34, such that juxtaposition of the nut shoulder 44 over the end portion shoulder 34 locks the nut and bushing together. It will be noted that the axial extent of the nut shoulder 34 is limited relative to the extent of the nut, and that the axial extent of the reduced end portion shoulder 44 is similarly limited, and that by virtue of these limited relative extents, the juxtaposition thereof is selective. Thus the locking of the inner housing 12 to the shaft 14, via nut 38 and bushing 26, is avoidable if the nut shoulder 34 is shifted axially beyond the reduced end portion shoulder 44, into area A in FIG. 1.

In this manner, the latch, albeit locked by the outside handle 18 in recess 16*a* and shaft 14 can be opened by rotation of the inside handle 46, provided the nut 38 is pushed out of locked engagement with the bushing reduced end portion shoulder 34.

The force needed to overcome the resistance of inner compression spring 30 is such that it is difficult to move nut 38 against the spring, and therefore, the nut 38 is shaped with a push button end 38*a*. The small area for application of force to the nut 38 and the need for the force to be axially applied makes it virtually impossible for the nut to be moved against the spring 30, and the inner housing 12 unlocked. The latch 10 is thus thiefproof. The latch 10 can, however, be readily opened by a person within the camper shell, by simply shifting the nut 38 such that bushing reduced end portion shoulder 34 is within Area A of the nut. The inner housing 12 is then rotatable by inside handle 46 and carries latch arms 50 pivoted at ears 52 from their keepers (not shown).

The foregoing objects are thus achieved,

I claim:

1. Camper shell door latch comprising inside latch means operated by a handle and an outside lockable shaft, and first and second relatively shiftable elements respectively acted on by said shaft and fixed to said latch means, said elements being engaged with each other in one position to block latch means operation in the locked condition of said shaft and disengaged from each other in a second, relatively shifted position while maintaining the outside locked condition of said shaft, whereby said latch means is operable from within said camper shell to unlatch said door while said shaft is locked from the outside.

2. Camper shell door latch according to claim 1, in which said elements are centered on the axis of said shaft, and shiftable axially relative to one another into and out of engagement.

3. Camper shell door latch according to claim 1, in which the first of said elements defines a circumferential shoulder, and the second of said elements defines shoulder cooperating structure circumscribing said shoulder, said second element structure being shiftable into and out of engagement with said shoulder by relative movement of said first and second elements.

4. Camper shell door latch according to claim 1, in which said first element shoulder has radial polygonal faces, and said second element has polygonal shoulder cooperating structure shaped and sized to engage said first element shoulder when in juxtaposition therewith.

5. Camper shell door latch according to claim 1, in which said first element shoulder is concentric with the axis of said shaft and limited in axial extent, said second element having shoulder cooperating structure having limited axial extent, whereby axial shifting of said first and second elements shifts said shoulder cooperating structure a distance greater than said shoulder axial length to disengage said shoulder cooperating structure from said shoulder.

6. Camper shell door latch according to claim 1, including also an inner housing rotatable by said shaft, said housing carrying said inside latch means, said first element comprising a bushing centering said shaft within said inner housing and fixed within said inner housing for rotation therewith by said shaft, said bushing having a reduced end portion opposite said second element, said bushing reduced end portion having a peripheral, polygonal shoulder of relatively limited axial extent, said second element comprising an interiorly open nut having an inner peripheral shoulder cooperating structure of relatively limited axial extent adapted to engage said bushing reduced end portion shoulder, said nut being supported by said inner housing in outwardly projecting relation and normally in engagement with said first element shoulder against rotation of said inner housing without simultaneous rotation of said shaft, said nut being inwardly axially shiftable over said bushing reduced end portion a distance greater than said limited axial extent of said bushing reduced end portion peripheral shoulder to free said nut of engagement with said bushing, whereby said inner housing is rotatable about said shaft and said latch means is actuable thereby without shaft rotation.

7. Camper shell door latch according to claim 2, in which the first of said elements defines a circumferential shoulder, and the second of said elements defines shoulder cooperating structure circumscribing said shoulder, said second element structure being shiftable into and out of engagement with said shoulder by relative movement of said first and second elements.

8. Camper shell door latch according to claim 7, in which said first element shoulder has radial polygonal faces, and said second element has polygonal shoulder cooperating structure shaped and sized to engage said first element shoulder when in juxtaposition therewith.

9. Camper shell door latch according to claim 8, in which said first element shoulder is concentric with the axis of said shaft and limited in axial extent, said second element having shoulder cooperating structure having limited axial extent, whereby axial shifting of said first and second elements shifts said shoulder cooperating structure a distance greater than said shoulder axial length to disengage said shoulder cooperating structure from said shoulder.

10. Camper shell door latch according to claim 9, including also an inner housing rotatable by said shaft, said housing carrying said inside latch means, said first element comprising a bushing centering said shaft within said inner housing and fixed within said inner housing for rotation therewith by said shaft, said bushing having a reduced end portion opposite said second element, said bushing reduced end portion having a peripheral, polygonal shoulder of relatively limited axial extent, said second element comprising an interiorly open nut having an inner peripheral shoulder cooperating structure of relatively limited axial extent adapted to engage said bushing reduced end portion shoulder, said nut being supported by said inner housing in outwardly projecting relation and normally in engagement with said first element shoulder against rotation of said inner housing without simultaneous rotation of said shaft, said nut being inwardly axially shiftable over said bushing reduced end portion a distance greater than said limited axial extent of said bushing reduced end portion peripheral shoulder to free said nut of engagement with said bushing, whereby said inner housing is rotatable about said shaft and said latch means is actuable thereby without shaft rotation.

11. In a camper shell door latch having inside quick release, comprising: a shaft; an outer housing adapted to be fixed to the outside of said camper shell door and centered on said shaft; an outer handle fixed to said shaft and journaled by said outer housing; locking means within said outer housing for locking said shaft relative to said outer housing; an inner housing on the inside said camper shell door; means centering said inner housing on said shaft, said inner housing being rotatable relative to said outer housing by said shaft, said inner housing carrying an inside handle and a latch means for latching and unlatching said camper shell door responsive to rotation of said inner housing; the improvement comprising said inner housing centering means comprising a bushing having a shoulder, and a cooperating nut normally engaging said shoulder to block rotation of said inner housing relative to said shaft, said bushing and said nut being relatively shiftable from inside said camper shell to disengage said shoulder and nut in inner housing rotation unblocking relation, whereby said inner housing is rotatable by said inside handle to unlatch said camper shell door in the locked condition of said locking means.

12. Camper shell door latch according to claim 11, in which said bushing and said nut are each centered on the axis of said shaft, and shiftable axially relative to one another into and out of engagement.

13. Camper shell door latch according to claim 12, in which said bushing defines a circumferential shoulder, and said nut defines shoulder cooperating structure circumscribing said shoulder, said nut being shiftable into and out of engagement with said shoulder by relative axial movement thereof.

14. Camper shell door latch according to claim 13, in which said bushing shoulder has outwardly radial polygonal faces, and said nut shoulder cooperating structure has inwardly radial polygonal faces shaped and sized to engage said bushing shoulder when in juxtaposition therewith.

15. Camper shell door latch according to claim 14, in which said bushing shoulder is concentric with said shaft axis, and limited in axial extent, said nut shoulder cooperating structure having limited axial extent, whereby axial shifting of said nut shoulder cooperating structure past said bushing shoulder disengages said bushing from said nut to permit rotation of said inner housing.

16. Camper shell door latch comprising an inner housing rotatable by a shaft, said housing carrying inside latch means, a first element comprising a bushing centering said shaft within said inner housing and fixed within said inner housing for rotation therewith by said shaft, a second element, said bushing having a reduced end portion opposite said second element, said bushing reduced end portion having a polygonal peripheral shoulder of relatively limited axial extent, said second element comprising an interiorly open nut having an inner peripheral shoulder of relatively limited axial extent adapted to engage said bushing reduced end portion shoulder, said nut being supported by said inner housing in outwardly projecting relation and normally in engagement with said first element shoulder against rotation of said inner housing without simultaneous rotation of said shaft, said nut being inwardly axially shiftable over said bushing reduced end portion a distance greater than said limited axial extent of said bushing shoulder to free said nut of engagement with said bushing, whereby said inner housing is rotatable about said shaft and said latch means is actuable without shaft rotation for opening said latch from within said camper shell.

17. Camper shell door latch according to claim 16, in which said housing defines an opening on the shaft axis, said nut is flanged at its inward end for capture at said inner housing opening and closed at its outer end to define a push button surface for application of force to shift said nut relative to said bushing.

* * * * *